US005286302A

United States Patent [19]

Wickham, III

[11] Patent Number: 5,286,302

[45] Date of Patent: Feb. 15, 1994

[54] METHOD FOR CLEANING INTERMEDIATE BULK CONTAINERS ON A MOBILE VEHICLE

[76] Inventor: Ward E. Wickham, III, 6380 Edison, Cumming, Ga. 30130

[21] Appl. No.: 878,177

[22] Filed: May 4, 1992

Related U.S. Application Data

[62] Division of Ser. No. 694,507, May 2, 1991, Pat. No. 5,137,043.

[51] Int. Cl.[5] ..... B08B 9/00; B08B 9/34

[52] U.S. Cl. ..... 134/22.1; 134/22.18; 134/24; 134/34

[58] Field of Search ..... 134/22.1, 22.18, 24, 134/25.1, 25.4, 34, 166 R, 167 R, 168 R, 171

[56] References Cited

U.S. PATENT DOCUMENTS

| | | | |
|---|---|---|---|
| 2,424,049 | 7/1947 | Parker et al. | 134/34 X |
| 2,549,837 | 4/1951 | Merritt | 134/168 R X |
| 3,046,163 | 7/1962 | Kearney et al. | 134/168 R X |
| 3,188,238 | 6/1965 | Lyon | 134/22.18 X |
| 3,563,464 | 2/1971 | Doornbos et al. | 134/167 R X |
| 3,615,822 | 10/1971 | Molinari | 134/23 |
| 3,798,066 | 3/1974 | Evans | 134/166 R X |
| 3,849,197 | 11/1974 | Sorrentino | 134/10 |
| 4,242,311 | 12/1980 | Middaugh | 134/167 R X |
| 4,424,082 | 1/1984 | Rowan | 134/254 |
| 4,653,518 | 3/1987 | Adachi | 134/167 R X |
| 4,724,009 | 2/1988 | Doyle et al. | 134/22.1 |
| 4,859,249 | 8/1989 | Valantini | 134/22.18 |

FOREIGN PATENT DOCUMENTS

| | | | |
|---|---|---|---|
| 1924562 | 1/1970 | Fed. Rep. of Germany | 134/168 R |
| 931534 | 6/1982 | U.S.S.R. | 134/22.18 |

OTHER PUBLICATIONS

Pamphlet, Allwaste Tank Services, Inc., *The Complete Serivce Company For Bulk Portable Tanks* Oct. 1989.

*Primary Examiner*—Mark L. Bell
*Assistant Examiner*—Saeed T. Chaudhry
*Attorney, Agent, or Firm*—Hopkins & Thomas

[57] ABSTRACT

Several intermediate bulk containers (11) are mounted on a trailer (10) by placing the IBCs on adjustable platforms (19). Flexible drain conduits (65) are connected to the bottom drain outlets of each IBC, and a high velocity spinner assembly (45) which is connected to a lid (41) is mounted to the upper manhole opening of each IBC, with the rotary nozzle (46) suspended inside the chamber (38) of the IBC. The loaded trailer vehicle is moved into the bay of a trailer tank cleaning facility, and the high pressure detergent supply of the facility is connected to the central supply conduit (66) of the trailer and its drain conduit is connected to the discharge conduit (68) of the trailer, so that the supply and drain system of the cleaning facility is utilized to clean the IBCs mounted on the trailer vehicle.

5 Claims, 5 Drawing Sheets

METHOD FOR CLEANING INTERMEDIATE BULK CONTAINERS ON A MOBILE VEHICLE

This is a divisional of copending application Ser. No. 07/694,507 filed May 2, 1991, now U.S. Pat. No. 5,137,043.

FIELD OF THE INVENTION

The present invention relates in general to a system for cleaning intermediate bulk containers, particularly to a trailer vehicle which can be transported between the location of the containers to load the containers and a cleaning facility where the containers can be cleaned while mounted on the vehicle.

BACKGROUND OF THE INVENTION

Intermediate bulk containers (IBCs), are larger than 60 gallon drums and smaller than tank trailers, usually holding about 300 gallons of liquid. Conventionally, the IBCs are used to carry inks, naphtha, paints, adhesives, and other commodities in quantities greater than available in 60 gallon drums.

The intermediate bulk containers used to carry such commodities become dirty and must be cleaned after use, particularly if the next liquid is to be different than the previous liquid. In the past the IBCs were cleaned by hand, whereby the worker sprayed and washed down the interior walls of the IBCs by rinsing, scrubbing, brushing, scrapping and wiping the inside surfaces. Depending on the nature of the substance contained within the IBC, this handwashing system can become very time consuming, whereby the time it takes to clean an IBC can may range from less than one hour to one entire day. Problems created by such manual cleaning methods include the time and labor costs utilized in cleaning the containers as well as the cost of the supplies and equipment required for the manual process. Also, in a manual cleaning process it is difficult to control the speed and quality of the work performed by the worker, and the amounts of water and cleaning fluids used in the cleaning process typically are uncontrolled.

Automated cleaning systems have been developed and used for cleaning IBCs. One such automated system includes a support stand that simultaneously supports several IBCs and further includes the pumps, tanks, conduits and other plumbing that are connectable to each IBC for supplying high pressure liquid detergent and other cleaning liquids to each IBC. The cleaning liquids are delivered through the upper man hole opening with sprinkler heads at a high pressure for impact cleaning of the interior walls of the IBCs and the residue is drained from each IBC through a common drain system.

A disadvantage in the known prior art automated cleaning systems is that the IBCs which are to be cleaned must be individually moved to the cleaning site and mounted on or otherwise connected to the cleaning equipment at the cleaning site, and after the cleaning process has been completed, the IBCs must be dismounted or otherwise disconnected from the cleaning equipment and individually moved away from the cleaning site to make room for the next IBCs to be cleaned. This causes a substantial amount of lost cleaning time for the cleaning equipment and requires periods of concentrated work in the vicinity of the cleaning facility by the people that move, connect and disconnect the IBCs with respect to the cleaning equipment.

A further disadvantage of the prior art IBC cleaning procedures and equipment is the requirement of maintaining control of the residue of the material removed from the IBC, of the cleaning detergents and of the other residual liquids which remain after the cleaning process has been completed. The residual liquids usually comprise a pollutant that must be collected and properly disposed of which requires the proper retention tanks, plumbing, etc. for gathering, storing and later discharging the liquids.

Cleaning equipment already exists for large bulk containers of the tank trailer construction which are towed on the highways. When the tank trailers are empty and are to be cleaned, the trailers are towed into a large cleaning bay of a building and hoses are connected between the openings of the tank trailer and the pumps and storage tanks of the cleaning facility. Streams of high pressure detergent and other liquids are sprayed by rotary nozzle systems about the inside surfaces of the tank of the trailer so as to remove the residue of the liquid previously hauled by the vehicle. The residue, including the detergent and the other liquids used in the cleaning process are drained from the tank of the trailer and stored for proper disposal. In some instances the detergents and cleaning liquids can be recycled during the cleaning of the same or of a subsequent trailer tank. Although the trailer tank cleaning systems are available for cleaning the large trailer tanks, there is no known system or equipment which permits efficient and economical use of the trailer tank cleaning systems for cleaning IBCs.

Thus, it would be advantageous to provide a system for cleaning intermediate bulk containers that thoroughly and swiftly cleans several IBCs at the same time, and which utilizes the existing facilities of a tank trailer cleaning system.

SUMMARY OF THE INVENTION

Briefly described, the present invention comprises a trailer vehicle for supporting several intermediate bulk containers and for moving the IBCs to a tank trailer cleaning facility and for supporting the IBCs as they are cleaned at the tank trailer cleaning facility. After the IBCs have been cleaned, the trailer and the cleaned IBCs are towed away for removal of the cleaned IBCs and for loading of more IBCs, and in the meantime another trailer vehicle loaded with IBCs is pulled into the bay for another cleaning cycle.

The trailer vehicle includes a plumbing system that is adaptable to an existing plumbing system of a tank trailer cleaning facility. The plumbing of the trailer connects to each IBC so that the detergents and other cleaning liquids of the cleaning facility can be used to clean the IBCs and the residual liquids are drained back to the cleaning facility for reuse, or for storage and disposal.

Upper and lower catwalks are provided on the trailer for workers to work at convenient heights to readily connect supply and drain conduits of the trailer vehicle to the IBCs. The conduit system of the trailer vehicle delivers a combination of high-pressure water and cleaning agents from the tank trailer cleaning facility supply lines to the IBCs mounted on the trailer. In a preferred embodiment, the trailer vehicle will support six IBCs for one cleaning operation. The supports on the trailer for the IBCs are adjustable to support the IBCs in an upright attitude for draining the residual liquids through a bottom drain opening or to support the IBCs in a tilted attitude to drain the residual liquids through a lower side drain opening of the IBCs. This allows the liquids of a washing cycle to flow through the IBCs and out of their bottom or side drain openings and down through a drain system of the trailer vehicle to the collection system of the cleaning facility.

The preferred embodiment trailer vehicle includes a cover or lid for each IBC mounted on the trailer, and the lid supports a rotary spinner mechanism for directing the high pressure water and cleaning agents against the interior walls of the IBC for impact cleaning of these surfaces. Normally, the spinner lid releasably seals the upper man hole opening of the container. Because the trailer is to be used to clean IBCs of different sizes, shapes and constructions, several sizes of spinner lids will be provided for the different size openings of the different IBCs for tightly sealing the openings during a cleaning operation.

It is therefore an object of the present invention to provide a vehicle for supporting several intermediate bulk containers and having on-board plumbing which is connectable to each IBC and to the plumbing of a cleaning facility so that the cleaning facility provides high pressure cleaning liquids to the IBCs and a drain system for discharging the residual liquids from the IBCs.

A further object of the present invention is to provide such a trailer vehicle having a plumbing system which is compatible with existing tank trailer cleaning facilities, which when operated, thoroughly wash down and cleans several IBCs, collects the residue from the IBCs and delivers the residue back to the tank trailer cleaning facility.

Another object of the present invention to provide a trailer vehicle which can be used to movably support and simultaneously clean multiple intermediate bulk containers, whereby the equipment of the trailer vehicle is uncomplicated for workers to efficiently operate.

A further object of this invention is to reduce the amount of manual labor and equipment which is normally required in the process of efficiently and effectively cleaning IBCs.

Another object of the present invention is to provide trailer vehicles which can be loaded with IBCs, which trailers include plumbing that is connectable to the IBCs, and after being loaded with and connected to the IBCs the trailers can be moved into a bay of a tank trailer cleaning facility for expedient and efficient use of cleaning facilities.

Other objects, features and advantages of the present invention will be understood from consideration of the following specification when taken in conjuction with the accompanying drawings.

DETAILED DESCRIPTION

Figure 1:
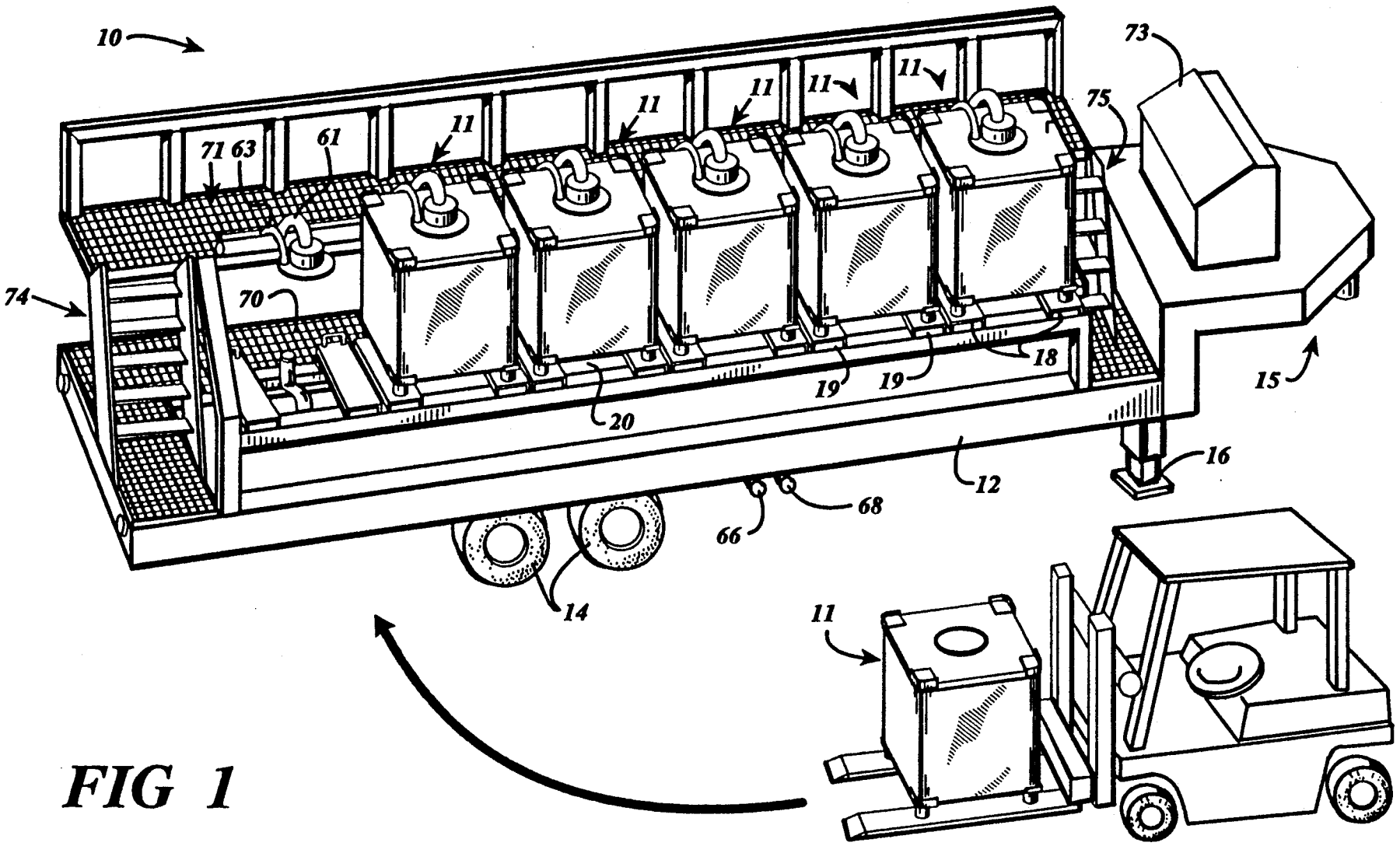
FIG. 1 is a perspective view of the trailer vehicle showing a bulk container being moved by a fork lift toward the vehicle and other bulk containers already positioned on the trailer.
Figure 2:
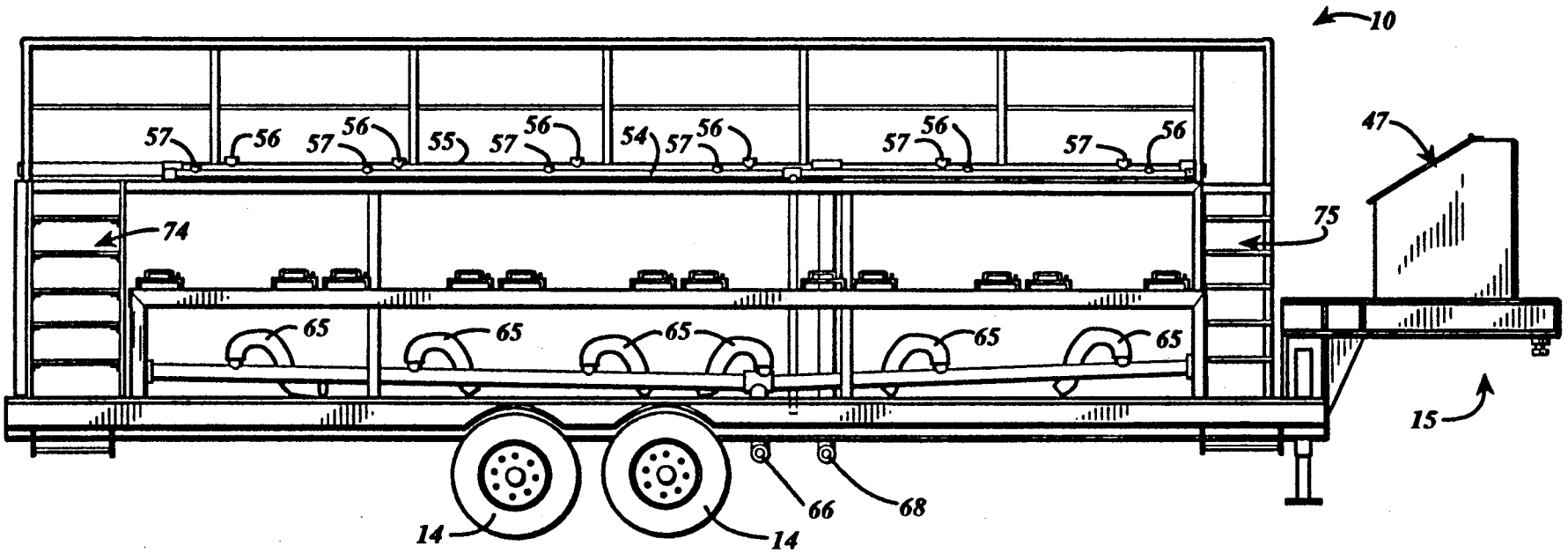
FIG. 2 is side elevational view of the trailer vehicle of FIG. 1.

Referring now in more detail to the drawings, in which like numerals indicate like parts throughout the several views, FIG. 1 illustrates the trailer vehicle 10 which is used for simultaneously cleaning a plurality of intermediate bulk containers 11 mounted on the trailer. The trailer includes a framework 12 that forms the vehicle chassis, with ground engaging wheels 14 attached to the rear of the framework and with a fifth wheel connector 15 attached to the front end of the vehicle. Retractable support legs 16 are suspended from the front portion of the trailer so as to support the trailer when the fifth wheel connector is not mounted to the towing vehicle.

The framework of the trailer supports a plurality of pairs 18 of container support platforms 19, with the pairs being spaced at intervals along the starboard side of the trailer, and with each pair of support platforms being spaced apart from one another so as to form access spaces 20 between the pairs of platforms.

Figure 3:
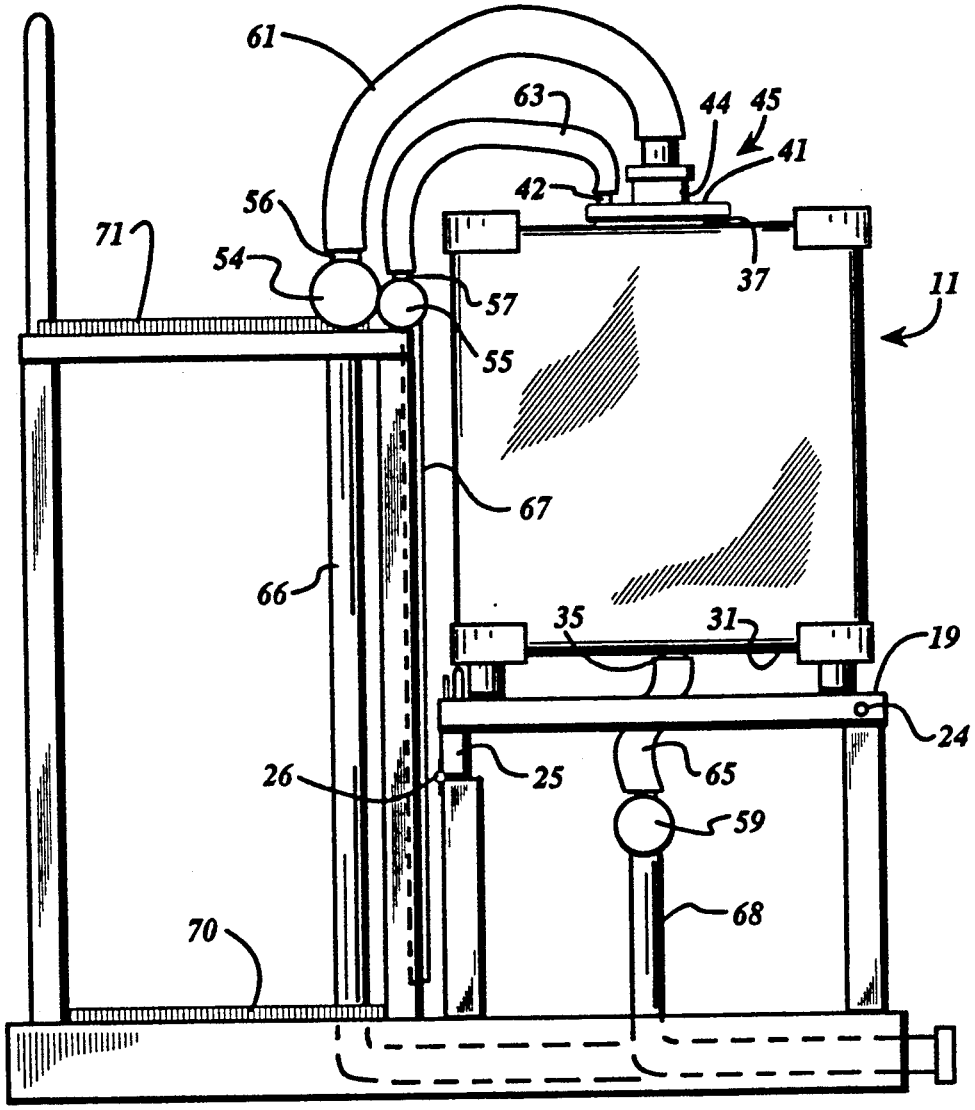
FIG. 3 is rear cross sectional view of the trailer vehicle of FIG. 1, showing a bulk container mounted on the container support member.
Figure 4:
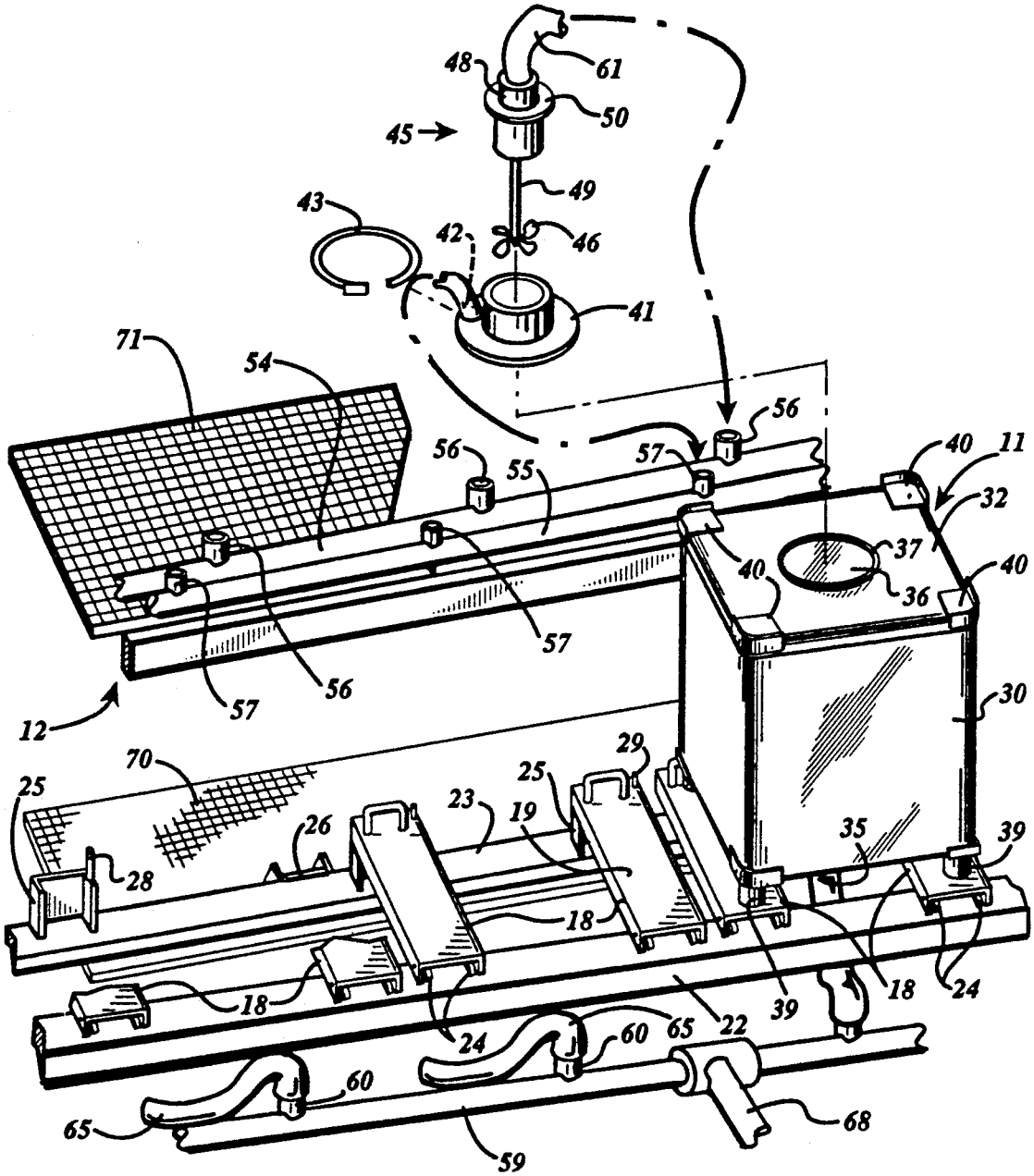
FIG. 4 is an exploded partial perspective view of an intermediate bulk container mounted on the trailer.

As shown in FIGS. 3 and 4, each platform 19 is supported at one end by outboard longitudinal support rail 22 and at the other end by inboard longitudinal support rail 23. Outboard rail 24 includes support blocks 24 that pivotably connect the outboard end of each platform 19 to the outboard support rail, while the inboard end of each platform 19 rests on inboard support rail 23. Height adjustment blocks 25 are mounted by means of hinges 26 to the inboard support rail and can be pivoted to an upright position beneath the inboard end of each support platform 19, so as to support the inboard end of the support platform in an elevated position. A locator pin 28 extends from each height adjustment block 25 and registers with an opening 29 in its support platform 19 when the adjustment block is pivoted to an upright position, so that a stable connection is made between the support platforms 19 and the height adjustment blocks 25. This adjustment feature permits each pair 18 of support platforms 19 to be adjusted so as to support an intermediate bulk container in an upright attitude or in a sloped attitude, depending on the location of the bottom outlet drain of the bulk container.

Figure 5:
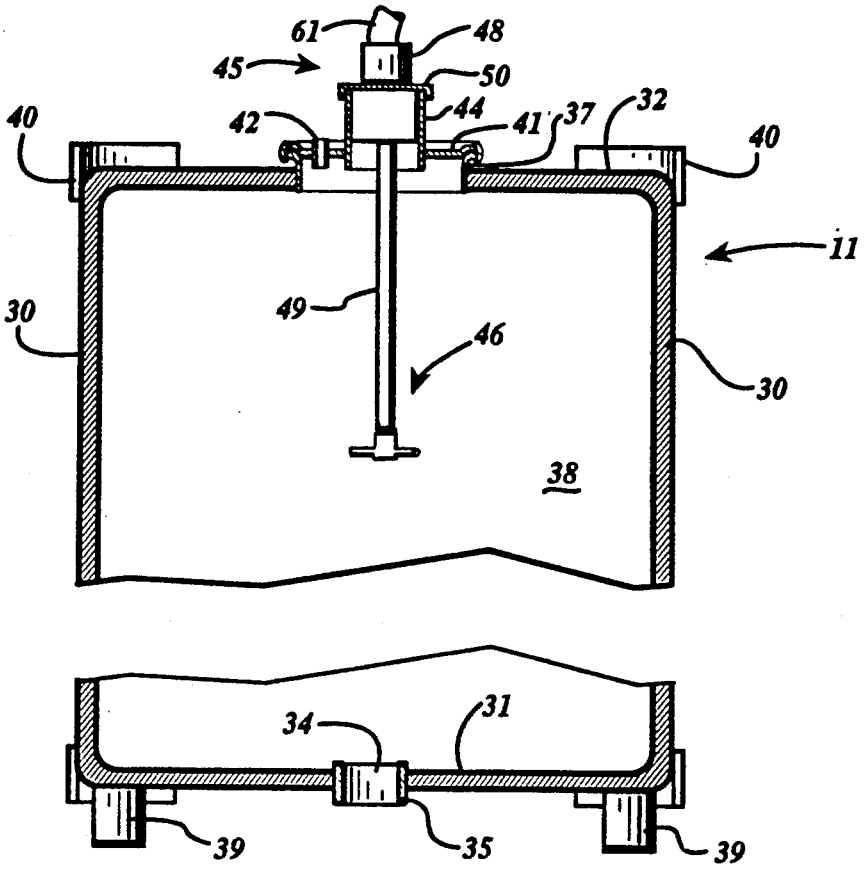
FIG. 5 is a partial side cross-sectional view of the bulk container and its spinner cover.

The bulk container 11 can be of various shapes and sizes, with some being of cylindrical configuration and others being of rectangular or cubical configuration. As illustrated in FIGS. 3-5, a conventional rectangular bulk container 11 includes upright side walls 30, a bottom wall 31 and a top wall 32. The bottom wall 31 defines an outlet opening 34 and a short outlet collar 35, and top wall 32 includes a manhole opening 36 with a collar 37. In some instances, the drain outlet opening 34 will be located adjacent one of the side walls 30, instead of at a central location as illustrated in FIG. 5. In most instances the bottom wall will be sloped toward the drain outlet opening.

When the drain outlet opening of the IBC 11 is located centrally of the bottom wall 31 as illustrated in FIG. 5, the height adjustment blocks 25 will be lifted to their upright position so as to support the pairs of container support platforms 18 in a horizontal attitude. When in this position, the platforms 19 will support the IBC in an upright attitude so that its contents will drain toward the drain outlet opening 34. However, should the drain outlet opening be located closer to one of the side walls 30, the height adjustment blocks 25 can be pivoted down out of the way so that the platforms 19 can rest directly on the inboard support rail 23, causing the platforms to be sloped and causing the IBC resting on the platforms to be supported in a tilted attitude, with the drain of the IBC located at a low position for assisting gravity flow of the residual liquid within the IBC toward the drain outlet opening.

The IBCs typically include support legs 39 adjacent each corner of the bottom wall 31, and brackets 40 attached to the top wall 32 adjacent each corner, so that the IBCs are stackable with their legs 39 nesting inside the brackets 40 of the next IBC below.

A cover or lid 41 is sized and shaped to fit the collar 37 of the manhole opening 36, a vent opening 42 is formed in the lid, and an upright collar 44 is mounted about the manhole opening through the lid. Clamp ring 43 (FIG. 4) clamps the lid 41 to the manhole collar 37. The upright collar 44 supports the spinner assembly 45, so that the rotary nozzle 36 of the spinner assembly 45 is suspended inside the chamber 38 of the IBC at a position suitable for directing liquids at high velocity against the sidewalls, bottom wall and top wall 30-32 of the IBC. The spinner assembly 45 includes a liquid driven motor 48 that rotates the shaft 49 and nozzle 46, with the spinner assembly being supported on cap 50 that mounts on top of collar 44. The spinner assembly is a commercially available product and is sold under the name Spraying Systems Spinner AA190A, Air Motorized Rotary Tank Washer, by Spraying System Company, Wheaton, Ill., U.S.A.

The trailer framework 12 further supports supply and drain conduits or "plumbing" which supplies fluids to and drains fluids from the IBCs 11. As shown in FIGS. 3 and 4, a high pressure supply conduit 54 and a low pressure vent conduit 55 extend longitudinally of the trailer, and connector spouts 56 and 57 are mounted at intervals along the conduits 54 and 55, respectively, with the connector spouts 56 and 57 being located adjacent each pair 18 of container support platforms 19. Likewise, a low pressure drain conduit 59 extends longitudinally of the trailer at a level below the platforms 19 and connector spouts 60 are mounted to the conduit 59 at intervals along its length that correspond to the spacing of the pairs 18 of support platforms.

Flexible conduits connect the supply conduit, vent conduit and drain conduit to each of the IBCs. For example, a flexible conduit 61 (FIG. 3) is provided for each pair of support platforms so as to connect a spout 56 of the high pressure supply conduit 54 to the spinner assembly 45, a flexible conduit 63 is provided for each pair of support platforms so as to interconnect the vent opening 42 of the lid of an IBC to the connector spout 57 of the low pressure vent conduit 55, and a flexible drain conduit 65 is provided for each pair of support platforms and connects the drain outlet opening 34 of an IBC to the connector spout 60 of the low pressure drain conduit 59.

The connector spouts 56 are quick disconnect valves which prevent liquid flow through the connector spouts 56 in the event that a flexible conduit 61 is not connected to the spout. This avoids inadvertent flow of high pressure liquid through a connector spout 56 that is not properly connected to a flexible conduit 61. With this arrangement, should the trailer vehicle 10 be loaded with less than its full capacity of IBCs, the high pressure cleaning liquid will not be delivered to the positions where no IBC is present.

Figure 6:
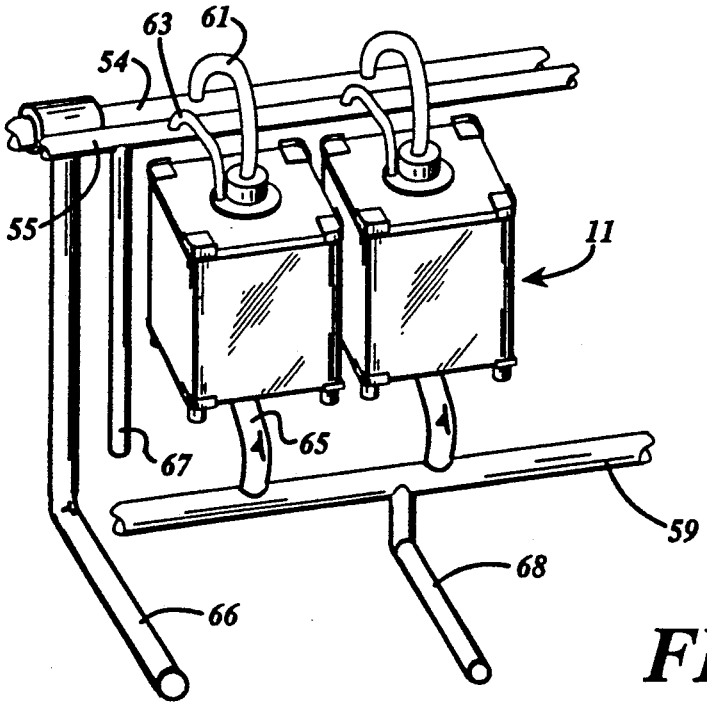
FIG. 6 is schematic view of the supply and drain system of the trailer and connected to the bulk containers.

As illustrated in FIG. 6, high pressure supply conduit 54 is connected to central supply conduit 66, low pressure vent conduit 55 is connected to downspout 67 and low pressure drain conduit 59 is connected to discharge conduit 68. Central supply conduit 66 and discharge conduit 68 extend to the port side of the trailer vehicle 10 for connection to the supply and drain conduit system of a tank trailer cleaning facility (not shown).

As best illustrated in FIG. 3, the container support platforms 19 are located approximately at mid-height of the trailer. Lower and upper catwalks 70 and 71 are positioned in the framework of the vehicle at elevation suitable for the worker to conveniently to connect and disconnect the flexible conduits 61, 63 and 65 to each IBC 11 mounted on the trailer vehicle. For example, the worker can stand on lower catwalk 70 and connect the upper end of each flexible drain conduit 65 to the drain collar 35 of the IBC, and the worker can stand on upper catwalk 71 and mount the lid 41 on the manhole collar 37 of the IBC. Typically, the flexible conduits 61 and 63 remain attached to the spinner assembly 45 and lid 41, so that the same lid 41 is used repeatedly with the IBCs to be cleaned. Of course, when an IBC 11 having a collar 37 of a different size or shape is placed on the trailer vehicle, the lid 41 will have to be exchanged for a lid of an appropriate size and shape.

A toolbox 73 is mounted at the forward end of the trailer vehicle so that extra lids 41, extra flexible conduits, extra fittings and tools can be stored on the trailer vehicle.

Ladders 74 and 75 are mounted at the rear and front ends of the trailer vehicle so as to enable the worker to reach the upper catwalk 71.

OPERATION

When a supply of intermediate bulk containers is to be cleaned, the trailer vehicle is moved by a tow vehicle (not shown) to the location of the IBCs, and a forklift or other loading device is used to lift and mount each IBC on the trailer vehicle. As illustrated in FIG. 1, each IBC 11 is placed on a pair 18 of container support platforms 19. If the IBC has a central drain in its bottom wall, the platforms 19 will be placed in their horizontal attitudes, by lifting the height adjustment blocks 25 to their upright positions (FIGS. 3 and 4), and resting the inboard ends of the support platforms 19 on the adjustment blocks. However, should the drain of the IBC be adjacent one of the sidewalls, the height adjustment block 25 can be pivoted about its hinge 26 so that it is out of the way of the support platform 19, causing the platform to rest directly on the inboard longitudinal support rail 23 and to be sloped downwardly from outboard toward inboard of the vehicle. The IBC is then placed with its legs 39 mounted on the platforms and its drain located inboard of the trailer vehicle so as to induce the residual liquid of the IBC to flow toward the drain opening. The drain opening of each IBC will be located in the access space 20 between the pairs of platforms 19.

Once the IBCs have been mounted on the platforms 19, the worker connects the flexible conduits 61, 63 and 65 to each IBC. Each flexible drain conduit 65 will have been previously connected to the low pressure drain conduit 59, so that the worker simply connects the other end of the flexible conduit 65 to the drain collar 35 of the IBC. Likewise, the flexible conduits 61 and 63 typically will have been connected to the spinner assembly 45 and lid 41 for the previous cleaning operation, so that these conduits remain connected to the spinner and lid, and the worker simply mounts the lid 41 to the manhole collar 37, by using a clamp ring 43 (FIG. 4).

After the IBCs have been mounted on the trailer vehicle and connected to the plumbing of the trailer vehicle, the trailer vehicle is ready for towing to the bay of the cleaning facility (not shown). If two or more trailer vehicles are available, workers can load and unload the trailer vehicles outside the cleaning facility while another trailer is inside the bay of the cleaning facility during the cleaning operation. By removing the entire trailer vehicle and its IBCs from the bay of the cleaning facility after the cleaning cycle and disconnected and unloading the IBCs outside of the bay of the cleaning facility, maximum use of the cleaning facility is achieved by not occupying the cleaning facility with the loading and connecting and disconnecting and unloading functions inside the bay.

When the trailer vehicle is towed into the bay of the cleaning facility, the worker must connect the central supply conduit 66 and discharge conduit 68 to the corresponding high pressure and drain conduits of the cleaning facility.

During the cleaning of the IBCs there are occasions when the high pressure liquid charged through the spinner assembly 45 might cause an increase in pressure within the chamber 38 of the IBC. Typically the high pressure will be exhausted through the drain outlet opening 34 and through the low pressure drain conduit 59. However, in those instances where the pressure is not properly vented through the drain, pressure can escape through the vent opening 42 of the lid 41, and through the flexible conduit 63 to the downspout 67. Downspout 57 typically is allowed to discharge to the floor of the bay of the cleaning facility because the fluid typically emitting through the downspout is gas; however, a bucket 79 or other receptacle can be utilized to collect any liquids to be emitted through the downspout, if desired.

It will be understood that the foregoing description relates only to a preferred embodiment of the present invention, and that numerous changes and modifications may be made therein without departing from the spirit and scope of the invention as set forth in the following claims.

I claim:

1. A method of cleaning intermediate bulk containers each with an upper opening and a lower drain opening comprising:

loading a plurality of the containers on a mobile vehicle, connecting a drain conduit system of the vehicle to the lower drain opening of each container, mounting a high velocity rotary nozzle in the upper opening of each container, connecting a high pressure liquid supply conduit system of the vehicle to each of said nozzles, moving the vehicle into a bay of a tank trailer cleaning system, connecting a high pressure liquid detergent supply of the tank trailer cleaning system to the high pressure liquid supply conduit system of the vehicle, connecting the drain conduit system of the vehicle to the drain system of the tank trailer cleaning system, operating the wash cycle of the tank trailer cleaning system to spray high velocity liquids from the rotary nozzles against internal surfaces of the containers and to drain the residual liquids from each container, after the wash cycle has been completed, disconnecting the high pressure liquid detergent supply of the tank trailer cleaning system from the high pressure liquid supply conduit system of the vehicle, disconnecting the drain conduit system of the tank trailer cleaning system from the drain conduit system of the vehicle and, moving the vehicle out of the tank trailer cleaning bay.

2. The method of claim 1 and wherein the step of loading a plurality of the containers on a mobile vehicle comprises adjusting the height of at least some of the bulk container platform means and placing the bulk containers on the adjusted bulk container platform means for supporting the bulk containers in an attitude with the drain opening of the container lowermost so that liquid can be completely drained therefrom.

3. The method of claim 1 and wherein the step of mounting a high velocity rotary nozzle in the upper opening of each container comprises supporting each nozzle on a lid, and mounting the lid on the bulk container.

4. A method of cleaning intermediate bulk containers each with an upper opening and a lower drain opening therein comprising:

loading a plurality of the containers on a mobile vehicle having ground engaging wheel means, connecting a drain conduit system of the vehicle to the lower drain opening of each container, mounting a high velocity rotary nozzle in the upper opening of each container, connecting a high pressure liquid supply conduit system of the vehicle to each of said nozzles, connecting a high pressure liquid detergent supply of a tank trailer cleaning system to the high-pressure liquid supply conduit system of the vehicle, connecting the drain conduit system of the vehicle to the drain system of the tank trailer cleaning system, operating the wash cycle of the tank trailer cleaning system to spray high velocity liquids from the rotary nozzles against internal surfaces of the containers and to drain the residual liquids from each container, after the wash cycle has been completed, disconnecting the high pressure liquid detergent supply of the tank trailer cleaning system from the high pressure liquid supply conduit system of the vehicle, and disconnecting the drain conduit system of the tank trailer cleaning system from the drain conduit system of the vehicle.

5. A method of cleaning intermediate bulk containers each with an upper opening and a lower drain opening therein comprising:

loading a plurality of the containers on a mobile vehicle, mounting a high velocity rotary nozzle in the upper opening of each container, connecting a high pressure liquid supply conduit system of the vehicle to each of said nozzles, moving the vehicle into a bay of a tank trailer cleaning system, connecting a high pressure liquid detergent supply of the tank trailer cleaning system to the high pressure liquid supply conduit system of the vehicle, operating the wash cycle of the tank trailer cleaning system to spray high velocity liquids from the rotary nozzles against internal surfaces of the containers and to drain the residual liquids from each container, after the wash cycle has been completed, disconnecting the high pressure liquid detergent supply of the tank trailer cleaning system from the high pressure liquid supply conduit system of the vehicle, and moving the vehicle out of the tank trailer cleaning bay.

* * * * *